US005628159A

United States Patent [19]

Younts

[11] Patent Number: 5,628,159

[45] Date of Patent: *May 13, 1997

[54] JOINT STRIP, METHOD OF FORMING A WALL USING THE JOINT STRIP AND WALL MADE THEREFROM

[76] Inventor: Patty L. Younts, 10 Eastview Dr., Lexington, N.C. 27292

[ * ] Notice: The term of this patent shall not extend beyond the expiration date of Pat. No. 5,311,717.

[21] Appl. No.: 321,215

[22] Filed: Oct. 11, 1994

Related U.S. Application Data

[63] Continuation-in-part of Ser. No. 199,565, Feb. 22, 1994, Pat. No. 5,487,250, which is a continuation of Ser. No. 859,472, Jun. 12, 1992, Pat. No. 5,311,717, which is a continuation-in-part of Ser. No. 452,763, Dec. 14, 1989, abandoned.

[51] Int. Cl.[6] ..... E04B 2/10

[52] U.S. Cl. ..... 52/417; 52/461; 52/467; 52/741.1

[58] Field of Search ..... 52/366, 396.04, 52/396.09, 415, 416, 417, 461, 467, 741.1

[56] References Cited

U.S. PATENT DOCUMENTS

| | | | |
|---|---|---|---|
| 2,129,497 | 9/1938 | Horn . | |
| 2,578,085 | 12/1951 | Perkins . | |
| 2,814,080 | 11/1957 | Tvorik et al. . | |
| 3,708,935 | 1/1973 | Kossuth et al. . | |
| 3,760,544 | 9/1973 | Hawes et al. . | |
| 4,059,933 | 11/1977 | Funk et al. . | |
| 4,157,271 | 6/1979 | Moore . | |
| 4,209,954 | 7/1980 | Scheid . | |
| 4,586,308 | 5/1986 | Jennings . | |
| 4,716,704 | 1/1988 | Murr . | |
| 4,737,218 | 4/1988 | Caldwell et al. . | |
| 5,065,960 | 11/1991 | Castellucci . | |
| 5,263,294 | 11/1993 | Koenig et al. . | |
| 5,311,714 | 5/1994 | Younts et al. . | |
| 5,333,433 | 8/1994 | Porambo et al. | 52/417 |

FOREIGN PATENT DOCUMENTS

| | | | |
|---|---|---|---|
| 1131642 | 10/1956 | France . | |
| 1283939 | 12/1960 | France . | |
| 1265957 | 1/1968 | Germany . | |
| 142751 | 4/1961 | U.S.S.R. | 52/417 |

*Primary Examiner*—Carl D. Friedman
*Assistant Examiner*—Kevin D. Wilkens
*Attorney, Agent, or Firm*—Bell, Seltzer, Park & Gibson, P.A.

[57] ABSTRACT

An improved joint strip for concealing a joint formed between two panels of adjacent wallboards formed of a flexible support strip capable of withstanding day-to-day wall vibrations and a rib adhered on one side of the support strip such that it extends the length of the support strip. The support strip may be formed from a variety of materials such as synthetic fibers, cellulose fibers, non-woven paper, plastic fibers, fiberglass, specially treated fabric, and mixtures thereof. The joint strip possesses superior strength and flexibility properties thus eliminating the need to use pre-decorated wallboard for forming a monolithic appearing wall.

5 Claims, 2 Drawing Sheets

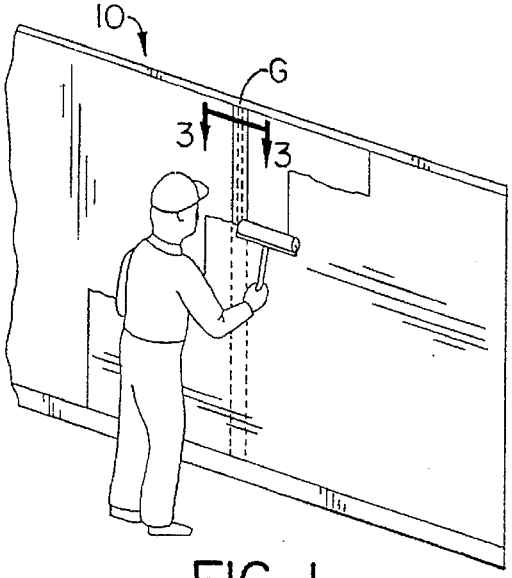
FIG. 1.
FIG. 2.
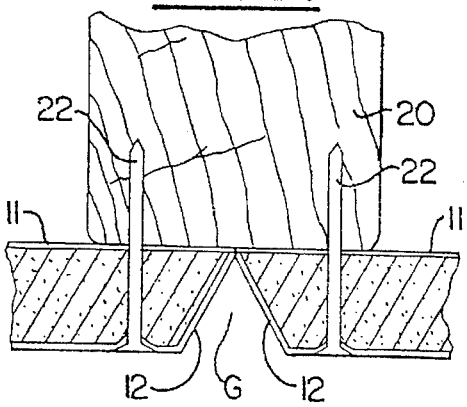
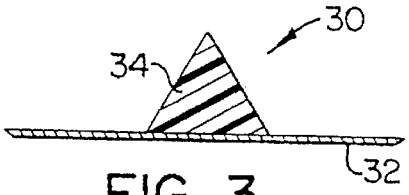
FIG. 3.
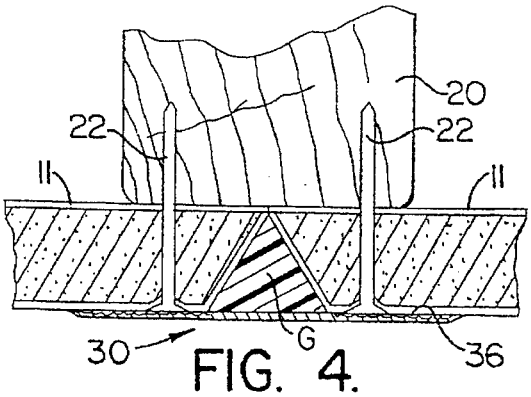
FIG. 4.
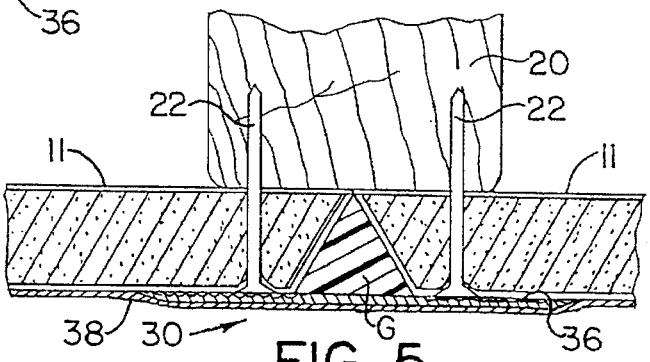
FIG. 5.

JOINT STRIP, METHOD OF FORMING A WALL USING THE JOINT STRIP AND WALL MADE THEREFROM

CROSS-REFERENCE TO RELATED APPLICATIONS

This application is a continuation-in-part of U.S. patent application Ser. No. 199,565, filed Feb. 22, 1994, and now U.S. Pat. No. 5,487,250 which is a continuation of U.S. patent application Ser. No. 859,472, filed Jun. 12, 1992, and now U.S. Pat. No. 5,311,717, which is a continuation-in-part of U.S. patent application 452,763, filed Dec. 14, 1989, and now abandoned.

BACKGROUND OF THE INVENTION

1. Field of the Invention

This invention relates to an improved joint strip for finishing the joint between two panels of adjacent wallboard and to the wall formed using the improved joint strip.

2. Description of the Prior Art

Wallboard building panels are widely used in the building industry, including the manufactured housing industry, to form relatively inexpensive and durable walls. Although the dimensions can vary, the wallboard building panels are typically manufactured in 4'×8', 4'×9', 4'×10', and 4'×12' sizes and are nailed, screwed, or otherwise secured to wall studs. Although the wallboard building panels may be easily secured to the wall support studs to form a wall, it is well known that the joints between the adjacent panels are difficult to hide or decorate. For example, U.S. Pat. No. 4,157,271 to Moore discloses a drywall filler for joining two conventional drywall building panels. The joint filler material is present in the shape of a tapered top strip with a center spline extending outwardly from the strip center. The strip is formed of a one-piece vinyl molded plastic member. The drywall filler is disadvantageous, however, in that it is incapable of being sanded to produce a smooth surface and that its sharp taper causes a discontinuity between joint filler and drywall surfaces.

Among the efforts to conceal the joint between wallboard building panels is the use of predecorated panels, which often tend to emphasize the joint rather than create a monolithic, seamless wall. For example, U.S. Pat. No. 3,816,199 to Dawdy et al. discloses a concealed joint for the fastening of a predecorated wallboard. The patent teaches pressing the edges of the predecorated sheet into joints formed between the panels and then inserting a decorative strip to hold the predecorated sheet edges in place in the joint. Similarly, U.S. Pat. No. 4,656,805 to Wenkowski discloses a paper batten for use in "concealing" the joints between predecorated gypsum wallboard. The batten is fabricated from predecorated wallboard paper with pressure-sensitive adhesive on the back thereof for securement over the joint. Unfortunately, the paper battens tend to wrinkle and fall off. Moreover, the battens when in place are still noticeable and do not create the appearance of a monolithic or seamless wall.

In U.S. Pat. No. 3,708,935 to Kossuth et al. a concealed joint for the fastening of predecorated wallboard is disclosed. Kossuth et al., however, uses a tapered edge wallboard and the "mud system" for filling the channel between the sheets and the tapered area. However, a significant shortcoming is that this method requires the use of tapered edge wallboard and considerable skilled labor to properly finish the joints.

Recent efforts, however, have focused on eliminating the need for skilled labor to form the "seamless" joints between adjacent predecorated wallboard building panels by pulling back edge flaps of the predecorated covering to expose the joint, adhering a joint strip over a groove formed by the adjacent wallboard panels, and positioning the wall covering edge flaps in an overlapping relationship. The overlapping portions of the edge flaps are removed, and the remaining portion of the edge flaps are adhered to the joint strip such that a smooth, seamless appearing joint surface is formed between the predecorated wallboards. One such system is set forth in U.S. Pat. No. 5,311,717, of which this application is a continuation-in-part. In this patent there is disclosed a wall formed of predecorated wallboard in which a groove has been cut to accommodate a joint strip. The joint strip is sealed in the groove and the flaps of the decorated wallboard are sealed over the joint strip. While that invention forms an attractive wall and provides benefits in reduced costs of manufacturing, it is limited, because of the nature of the joint strip, to walls formed of predecorated wallboard.

The present invention overcomes the deficiencies of the prior art by using a joint strip with superior properties thereby eliminating the requirement to use predecorated wallboard for forming a monolithic appearing wall.

It is therefore the general object of the present invention to provide an improved joint strip for finishing the joint between two sheets of adjacent wallboard.

Another object of the present invention is to provide a method for making a monolithic appearing wall formed using the joint strip of the present invention.

A further object of the present invention is to provide a monolithic appearing wall which eliminates the need to fill joints with joint compound and the substantial skilled labor requirements to properly apply the joint compound.

A still further object of the present invention is to provide an improved joint strip which is capable of withstanding movement connected with daily usage such that predecorative covering is no longer necessary.

SUMMARY OF THE INVENTION

In accordance with the present invention, there is provided a joint strip, and a method of joining wallboards to conceal the joint therebetween without the need for predecorated wallboard covering, joint compound, battens, and similar conventional techniques now in use in building construction. The joint is finished by attaching a joint strip which is formed of a support strip having a center rib along the length thereof adapted to matingly fit within a groove formed by the adjacent wallboard panels. The support strip extends laterally over at least a portion of the wallboard adjacent to the longitudinal edge of each of the adjacent wallboards.

The support strip is made of material which is strong enough to withstand normal vibration that occurs during normal usage, for example, synthetic fibers, cellulose fibers, non-woven paper, plastic fibers, fiberglass, specially treated fabric, and mixtures thereof. Moreover, a mixture of synthetic fibers, cellulose fibers, plastic fibers, fiberglass, and non-woven paper can be used. The rib is adhesively secured to the support strip and may be constructed of PVC, recycled PVC, other plastics, rubber, cellulose, fiberglass, ceramic or the like, either in its pure or recycled state and mixtures thereof. The rib is affixed to the support strip so as to allow for flexing of the joint strip without delamination occurring.

In practice, a wall is formed by attaching a pair of wallboards to wall studs or the like, in either abutting or closely adjacent relationship. The longitudinal edges of the wallboard sheets may be square edged or preformed edged. Further, the sheets may be either predecorated or undecorated.

In the one embodiment, the wall is made with wallboard panels having preformed edges, say for example, at an angle such as a 45° angle or the like such that a V-shaped groove is formed when the wallboard panels are adjacent to one another. The rib of the joint strip is then placed in the groove and the strip adhered to the longitudinal edge of the wallboards. In another embodiment, the wallboards are of the conventional square edged type at the time of attachment to the wall studs. Subsequent to attachment, a groove is cut along at least a substantial portion of the length of the joint between the adjacent wallboards. The rib of the joint strip is then placed in the groove and the strip secured to the wallboards.

When the wall is completed using the joint strip of this invention, the joint surface is sufficiently smooth so that a monolithic appearing wall is formed when a topical treatment, e.g., paint or wall covering, is applied thereto.

BRIEF DESCRIPTION OF THE DRAWINGS

Other objects, features and advantages of the invention will become evident as the description proceeds, when taken in connection with the accompanying drawings, in which:

FIG. 1 is a perspective view of a monolithic appearing wall showing in part a finished joint illustrating use of the joint strip of the present invention;

FIG. 2 is a horizontal cross-sectional view of the two adjacent wallboard panels shown in FIG. 1 illustrating the groove into which the joint strip is placed;

FIG. 3 is a cross-sectional view of the joint strip of the present invention taken along line 3—3 of FIG. 1;

FIG. 4 is a horizontal cross-sectional view of two adjacent wallboards with the joint strip of the present invention adhered to the groove formed in the joint therebetween;

FIG. 5 is a horizontal cross-sectional view of two adjacent wallboards with the joint strip of the present invention adhered to the groove formed in the joint therebetween and covered with paint to form a monolithic appearing wall.

DETAILED DESCRIPTION OF THE PREFERRED EMBODIMENT

Figure 6A:
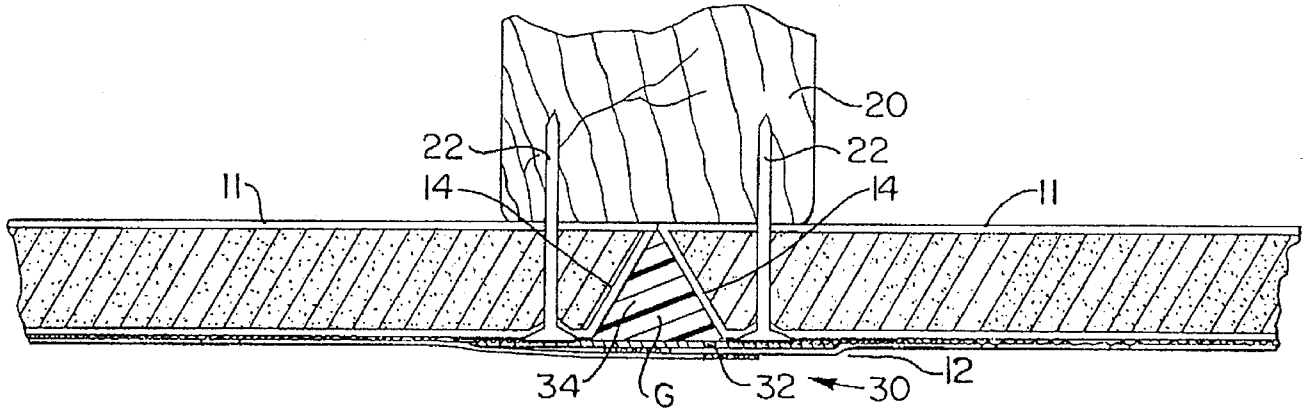
FIG. 6A is a horizontal cross-sectional view of two adjacent wallboards with the joint strip of the present invention adhered to the groove formed in the joint therebetween and covered with a pre-decorated wall covering prior to installation of the wallboards to form a monolithic appearing wall.

Referring now more specifically to the drawings, FIG. 1 shows a perspective view of a preferred embodiment of the monolithic appearing wall indicated generally at 10. With specific reference now to FIG. 2 of the drawings, it can be seen that wallboard panels 11 with a formed edge 12 are nailed in adjacent positions to stud 20 with nails 22. The wallboard 11 may be comprised of gypsum, fiberglass, plywood, fiberboard, particleboard, laminated cellulose sheets, epsom board, plastic, ceramic, or any combination of the above. It should be noted that the wallboards can be of any size and thickness. Typically manufactured sizes are 4'×8', 4'×10', 4'×12', 2'×8', 2'×10', 2'×12' and thicknesses of 5/16", 3/8", 1/2", 5/8", 3/4", and 1". It should be understood that these dimensions of length, width, and thickness do not serve as a limitation upon the claimed invention. The determination of the relationship of the wallboard panels 11 to each other will depend upon the size and shape of joint strip 30, shown in FIG. 3. Although wallboard panels 11 are depicted as nailed to a wooden stud, it is contemplated that wallboard panels 11 of varying lengths, widths, and thicknesses may be nailed, screwed, stapled, glued, foamed or otherwise secured into place on metal, wood, fiberglass or plastic wall studs by centering the joint formed between adjacent panels 11 over a stud. In fact, if desired, two foot wide boards may be combined into a "sandwich" type construction using gypsum spacers to create a wall unit that does not require studs for support.

Continuing to refer to FIG. 2, when wallboard panels 11 have been nailed to stud 20 in adjacent relationship, a groove G must be formed within the joint of the wallboard either by using preformed wallboards or by cutting the groove. Preformed edges may be produced by cutting the ends of square edged wallboard prior to installation or they may be formed during manufacturing of the wallboard panel. Although a V-shaped groove is shown in FIG. 2, a U-shaped or modified rectangular groove may also be formed. By preforming the edges, any irregularities in the thickness in square edge outside edges will be removed such that a desirable straight vertical joint is formed upon wallboard assembly.

Referring now to FIG. 3, there is shown a semi-flexible joint strip 30. Joint strip 30 comprises a support strip 32 and a rib 34. Most suitably, the flexible support strip 32, about 4 to 5 inches wide, is a strip of a suitable thickness which may be constructed of synthetic fibers, cellulose fibers, non-woven paper, plastic fibers, fiberglass, specially treated fabric and mixtures thereof or a mixture of synthetic fibers, cellulose fibers, plastic fibers, fiberglass, and non-woven paper may be used. For the purposes of this invention, a specially treated fabric is any fabric which is capable of withstanding normal day-to-day vibrations and which is capable of concealing fastener indentations. For example, any woven or knitted fabric comprised of a variety of materials including, for example, a cotton-polyester blend, nylon, polyester, and the like, can be successfully employed. The fabric is specially treated in that starch, latex, or a backing of acrylic is applied to impart a sufficient level of stiffness. It should be stressed that in order to achieve sufficiently narrow support strip edges, a selvage of any suitable material may be employed in conjunction others listed. In one example, silk may be used.

In a preferred embodiment, the support strip is a non-woven cellulose paper that has been calendared to about 0.0075Δ thick at its thickest point. The smooth wall surface is obtained by calendaring the edges of the strip to a thickness of about 1 to 2 thousandths of an inch. A most preferred strip composition is a blend of cellulose material containing between about 10% and 50% by weight of polyester fibers, most preferably approximately 20% by weight of polyester fibers. The blend is processed via a calendaring process which uses water, heat (approximately 275° F.) and pressure (approximately 20 psi) to "mash" the irregularly aligned cellulose and polyester fibers into the finished sheet. While the thickness may vary the calendared sheet is from about 2 to about 10 thousandths of an inch thick. When the edges of the strip have not been calendared to the desired thickness, the edges may be sanded to a thickness of about 1 thousandth of an inch thus allowing a visually flat joint seam to appear. Although in this embodiment polyester fibers are used for strength, other synthetic fibers such as nylon, fiberglass, and the like may also be employed.

Rib 34 is adhesively secured to support strip 32. It should be noted that the purpose of the rib 34 is to fill the void created between adjacent wallboard panels upon formation of groove G such that a monolithic appearing wall may be formed. Accordingly, rib 34 may be constructed of any material suited for this stated purpose including, but not limited to, polyvinyl chloride (i.e., PVC), recycled PVC, other plastics, rubber, cellulose, polyvinyl acetate, fiberglass, ceramic or the like, either in its pure or recycled state. Mixtures of any of the above may also be utilized. Preferably, rib 34 is semi-flexible. In accordance with the invention, the term semi-flexible refers to those materials which allows rib 34 to be rolled up or otherwise compacted in any fashion without it breaking. Rib 34 is affixed by means of an adhesive to support strip 32 so as to allow for flexing of joint strip 30 without delamination occurring. Preferably, a hot melt glue is used to adhere a recycled PVC rib 34 to the support strip 32, although other adhesives may be used. Also, the shape and dimensions of rib 34 will normally correspond to the size and shape of groove G. In practice, however, a rib 34 of a thickness of about 5/16 of an inch is utilized regardless of the board panel thickness as the v-shaped surfaces of the rib do not have to contact groove G. Accordingly, rib 34 is able to freely float during normal day-to-day usage.

Several advantages are realized by utilizing this improved joint strip. First, the material can withstand severe experimental tests for racking in which the wallboard panels are subjected to stress and movement to throw them out of parallel alignment. Such results indicate that the support strip material structure is capable of withstanding movement and vibration associated with day-to-day usage without breaking. Second, the support strip structural properties are such that the strip tautly spans across nail, screw, or fastener indentations formed when the wallboard is attached to studs. Third, the need to caulk the joint is eliminated as the irregularly aligned fibers in the support strip allow the strip to be flexible in many directions. When the wallboard moves and flexes, the support strip "floats" in the joint thus rendering the caulking unnecessary. Fourth, the use of water in the processing of the strip gives the support strip excellent tensile strength under wet and dry conditions. Finally, the support strip can be beveled to a thickness of about 1 thousandth of an inch, creating a visually flat seam.

As shown in FIG. 4, the joint strip 30 is affixed to wallboards 11 by means of an adhesive 36 such that rib 34 matingly fits within groove G. Several methods may be used in adhering the joint strip.

1. A water-based adhesive which is preferably ethylvinyl acetate is brushed, rolled or sprayed onto the surface area adjacent to the side edges of the wallboards and the joint strip 30 is then pressed onto the wallboard surfaces with a roller, brush, by hand or by trowel.

2. A pre-applied pressure sensitive adhesive is applied to the back of the joint strip 30. Just prior to application, the release paper is peeled away from the back of the joint strip 30, the rib 34 is positioned into the groove G and pressure is applied to the outside face of the joint strip 30 by a roller brush, trowel or by hand to press the support strip against the surface of the wallboard.

3. A hot melt glue is pre-applied to the back of the joint strip 30. The rib is matingly positioned in the groove G and is held into position while an iron or other heating element is rubbed across the outside face of the joint strip 30. By using pressure and heat, the hot melt glue on the back of the joint strip 30 is adhered to the surface of the wallboard.

In all three examples, ethylvinyl acetate is the preferred adhesive as it remains slightly flexible in its cured state, although other adhesives such as polyvinyl acetate may also be employed. It should be emphasized that regardless of the source of adhesive used to secure joint strip to the wallboard surface, the bonding thereof creates a smooth joint between wallboards without the necessity for sanding, puttying or filling of the joint or necessity of covering the joint with battens or the like. This is very significant since the joint strip 30 eliminates the mess and drying time required when using a "mud" system as well as the necessity for use of skilled laborers to form a smooth joint. Moreover, if the simple expedient of attaching battens were to be used to cover the joint, the appearance of the fully constructed wall is not monolithic and, in fact, unattractive due to the presence of periodic batten strips thereon.

After the joint strip 30 is adhered to the wallboard 11, a topical treatment 38 may be employed to give the wall a monolithic, uniform appearance. This can be accomplished by utilizing either of two types of materials, paint or wallcovering.

As shown in FIG. 5, either a heavy bodied paint or an aggregate based paint is preferred as a paint covering. The heavy bodied paint should be thick enough to cover the joint strip and surrounding wallboard such that the edges of the joint strip will not show through the paint surface. An aggregate based paint is a paint that has aggregate materials added to the paint mixture to give the painted surface a textured or pebbled finish. The addition of aggregate gives any paint additional hiding ability to prevent the edge of the joint strip from showing through the finish. It should be noted that the wallboard and joint strip may be sanded before the paint is applied or between coats of paint in accordance with the current industry norm; nonetheless, this sanding step is not necessary.

In the embodiment shown in FIG. 6A, a predecorated wallcovering sheet can be employed as a cover over the joint. In this instance, applying paint or wallcovering to the wallboard is no longer necessary as the predecorated sheet serves to create a monolithic, seamless appearing wall. Representative methods of assembling of predecorated square edge wallboard panels is described in U.S. Pat. No. 5,311,717, incorporated herein by reference. Any wallcovering such as paper, non-woven paper, vinyl, backed vinyl, fiberglass, synthetic fibers, grasses, hemp, other natural products and mixtures thereof can be used. The wallcovering is applied to the wall on-site using the wallcovering manufacturer's recommendations.

With reference to FIG. 6A, the predecorated wallboard wall and the method of construction thereof can be further described. In this embodiment, it can be seen that predecorated beveled edge wallboards 11 are placed in abutting relationship over wooden stud 20 and nailed thereto with nails 22. It should be appreciated that the wallboards do not have to be in abutting relationship. The determination of the relationship of the wallboards to each other will depend upon the size of the joint strip 30. Although wallboards 11 are depicted as nailed to a wooden stud, it is contemplated that predecorated square edge wallboards 11 of varying lengths, widths, and thicknesses may be nailed, screwed, stapled, glued, foamed or otherwise secured into place on metal wood, fiberglass or plastic wall studs by centering the joint formed between adjacent wallboard panels 11 over a stud. When adjacent wallboard panels 11 have been nailed to stud 20 in adjacent relationship to form the joint, predecorated sheets 12 are pulled backward to expose a 3 inch uncovered gypsum board surface strip adjacent to the side edge of each gypsum board 14 and the groove formed and the joint covered by one of the methods described in U.S. Pat. No. 5,311,717.

Referring also to FIG. 6A, it can be appreciated that in order to fully finish the smooth joint formed by the adherence of the joint strip 30 to groove G, the edge flaps of the predecorated sheets 12 are released and allowed to overlap. Next, a vertical cut is made through both edge flaps with a metal straight edge and razor blade or knife, and the edge flaps are peeled back and loose edge strips 12 are removed.

Figure 6B:
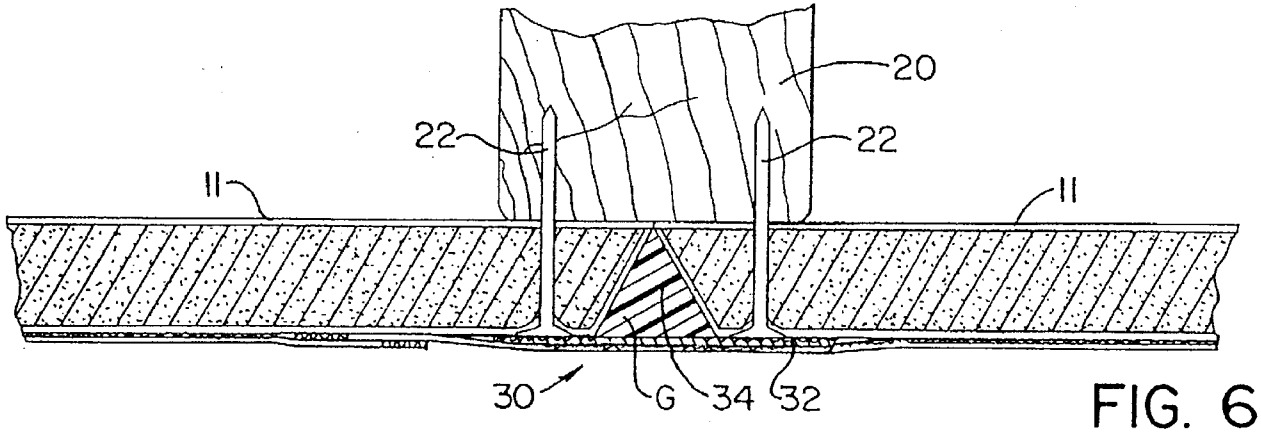
FIG. 6B is a horizontal cross-sectional view of two adjacent wallboards with the joint strip of the present invention adhered to the groove formed in the joint therebetween and covered with a wall covering on the installation site to form a monolithic appearing wall.

Additionally, wallcovering may be applied to the adjacent wallboard panels after installation of the joint strip 30. FIG. 6B, for example, depicts wallcovering which has been applied on site. In accordance with the invention, the wallcovering can cover adjacent wallboard panels in any fashion that allows a monolithic appearing surface to result. In FIG. 6B, the edge flaps of the wallcovering are positioned away from the joint strip; it should be stressed that this illustrated embodiment is not limiting, but is only one example of numerous variations.

In should be appreciated that although certain features of the invention are shown in slightly enlarged representation in several drawings for greater clarity of understanding, the wallboard joint contemplated by the invention is substantially flat and parallel to the outer wall surfaces and thus forms a "seamless" and monolithic appearing wall. The semiflexible nature of the joint strip allows it to be formed into rolls for easy handling.

It will be understood that various details of the invention may be changed without departing from the scope of the invention. Furthermore, the foregoing description is for the purpose of illustration only, and not for the purpose of limitation—the invention being defined by the claims.

What is claimed is:

1. A joint strip for concealing a joint formed between two panels of adjacent wallboards secured to studs to form a wall comprising:

a flexible support strip formed of a blend of cellulose fibers and from 10 to 50% by weight polyester fibers, said support rib capable of withstanding movement and vibration associated with day-to-day usage without breaking; and having a rib adhered on one side of said support strip such that said rib extends the length of said support strip and is shaped to be matingly received by a groove formed between said panels.

2. The joint strip according to claim 1 wherein said rib is substantially V-shaped.

3. A semi-flexible joint strip for concealing a wallboard. joint comprising:

a support strip comprised of a blend of cellulose fibers and from 10 to 50% by weight polyester fibers; and a rib comprising a material selected from the group consisting of PVC, recycled PVC, rubber, cellulose, fiberglass, ceramics, and mixtures thereof, said rib being adhered on one side of said support strip such that said rib extends substantially the length of said support strip.

4. A monolithic appearing wall comprising:

adjacent undecorated wallboard panels having preformed edge portions forming a joint having a groove therebetween;

said joint forming said groove provided within the edges of said adjacent wallboard panels along at least a substantial portion of the length of the joint formed therebetween;

a joint strip secured to said groove comprising a support strip formed of a blend of cellulose fibers and from 10 to 50% by weight polyester fibers which extends laterally over at least a portion of the wallboard panels adjacent to the side edges of each of said adjacent wallboard panels, and a rib adhered on one side of said support strip such that said rib extends the length of said support strip, said rib shaped to be matingly received by a groove formed between said panels; and a topical treatment covering said wall such that said wall appears monolithic.

5. The wall according to claim 4 wherein said rib is substantially V-shaped.

* * * * *

UNITED STATES PATENT AND TRADEMARK OFFICE
CERTIFICATE OF CORRECTION

PATENT NO. : 5,628,159

DATED : May 13, 1997

INVENTOR(S) : Younts

It is certified that error appears in the above-identified patent and that said Letters Patent is hereby corrected as shown below:

Column 3, line 43, omit "and".

Column 3, line 49, after "wall" change the period (.) to a semicolon (;) and add --and--.

Column 4, line 49, after "conjunction' add --with--.

Column 4, lines 52, 63 and 65, "calendared" should be --calendered--.

Column 4, lines 54 and 60, "calendaring" should be --calendering--.

Column 4, line 53, "0.0075Δ should be --0.0075"--.

Column 5, line 27 "v-shaped" should be --V-shaped--.

Column 8, line 10, after "wallboard" omit the period (.).

Signed and Sealed this

Twenty-eighth Day of April, 1998

Bruce Lehman

*Attest:*

BRUCE LEHMAN

*Attesting Officer*

*Commissioner of Patents and Trademarks*